United States Patent [19]

Durocher

[11] Patent Number: 4,615,345

[45] Date of Patent: Oct. 7, 1986

[54] WRAPPER CONSTRUCTIONS FOR SELF-EXTINGUISHING SMOKING ARTICLES

[75] Inventor: Donald F. Durocher, Roswell, Ga.

[73] Assignee: Kimberly-Clark Corporation, Neenah, Wis.

[21] Appl. No.: 627,711

[22] Filed: Jul. 11, 1984

Related U.S. Application Data

[63] Continuation-in-part of Ser. No. 521,306, Aug. 8, 1983, abandoned.

[51] Int. Cl.[4] ..... A24D 1/02

[52] U.S. Cl. ..... 131/365; 131/331; 131/358; 131/364

[58] Field of Search ..... 131/358, 365, 331, 364

[56] References Cited

U.S. PATENT DOCUMENTS

| | | | |
|---|---|---|---|
| 1,555,320 | 9/1925 | Weil . | |
| 1,996,002 | 3/1935 | Seaman . | |
| 1,999,222 | 4/1935 | Wineberger . | |
| 2,013,508 | 9/1935 | Seaman . | |
| 2,049,320 | 7/1936 | Ruben . | |
| 2,329,927 | 9/1943 | Richards . | |
| 2,718,889 | 9/1955 | Claussen . | |
| 3,030,963 | 4/1962 | Cohn . | |
| 3,667,479 | 6/1972 | Sanford et al. . | |
| 4,187,862 | 2/1980 | Cohn . | |
| 4,230,131 | 10/1980 | Simon . | |
| 4,461,311 | 7/1984 | Mathews et al. | 131/365 |

*Primary Examiner*—V. Millin

*Attorney, Agent, or Firm*—William D. Herrick

[57] ABSTRACT

The invention is an improved specially designed wrapper construction for smoking articles producing controlled burn properties of smoking articles such as cigarettes so that the cigarette will self-extinguish after free burning in air for a designed time period. In addition, the wrapper construction results in cigarettes with reduced tendency to ignite combustible substrates, such as upholstered furniture, when in contact with them. Therefore, smoking articles with this wrapper construction reduce the likelihood of accidental fires, yet they free-burn rapidly for a designed period of time without puffing. However, during a normal puffing sequence the behavior of cigarettes with these wrappers is indistinguishable from commercial cigarettes. On the other hand, other self-extinguishing cigarettes go out without puffing and therefore have to be relighted frequently. The wrapper constructions of the present invention include single or double wraps of cigarette paper which are inherently incapable without elevated levels of burn promoting chemical or supporting cigarette free burn. The construction is modified by application of a plurality of zones of elevated levels of burn promoter to the extent that the cigarette burns normally in the treated zones. Thus, when the burning coal advances to an area of untreated wrap, it reliably self-extinguishes unless puffed. The extent of the treated zones controls the time required for the cigarette to self-extinguish. Required wrappers are preferably those having a Burn Mode Index ("BMI") as defined in the range of from about 1.5 $cm^{-1}$ to about 6.0 $cm^{-1}$ for the single wrap embodiment and, for the double wrap embodiment, about 0.1 $cm^{-1}$ to about 4.0 $cm^{-1}$ for the inner wrap and about 2 $cm^{-1}$ to about 40 $cm^{-1}$ for the outer wrap depending on the BMI of the inner wrap. The wrappers and smoking articles of the invention may be produced using conventional methods and equipment.

20 Claims, 9 Drawing Figures

WRAPPER CONSTRUCTIONS FOR SELF-EXTINGUISHING SMOKING ARTICLES

This application is a continuation-in-part of my copending application Ser. No. 521,306, filed Aug. 8, 1983, now abandoned.

BACKGROUND OF THE INVENTION

1. Field of the Invention

The present invention relates to wrappers for smoking articles such as cigarettes and especially to such wrappers which reduce the tendency of cigarettes to cause ignition of surfaces which come in contact with the lit cigarette. Reports have been made of fires attributed to burning cigarettes coming in contact with combustible materials. Such reports have generated interest in reducing the tendency of cigarettes to ignite surfaces and materials included in furniture, bedding, and the like upon contact. One obviously desirable attribute of cigarettes in this regard would be that they extinguish themselves if left unattended for a period of time whether in an ash tray or in open air. Since it is recognized by those skilled in the art that the wrapper construction for the cigarette strongly influences the behavior of the cigarette during smolder, modification of the wrapper to achieve these desired results would be highly beneficial. In particular, a wrapper construction that does so without serious detrimental effects on desired smoking properties and characteristics would be especially advantageous. The present invention is directed to such wrapper constructions and improved smoking articles utilizing them.

2. Description of the Prior Art

The subject of reducing the tendency of cigarettes to ignite upholstery, bedding, and the like has received much attention.

Considerable effort has been directed to modifications of cigarette papers for the purpose of reducing fire hazards, including the development of non-burning wrappers, for example, as disclosed in U.S. Pat. No. 2,998,012 to Lamm dated Aug. 29, 1961, and the design of wrappers having patterned rings or areas of non-burning materials, for example, as disclosed in U.S. Pat. No. 4,044,778 to Cohn dated Aug. 30, 1977.

It is also known, as in U.S. Pat. No. 4,231,377 to Cline, for example, to treat conventional wrappers with chemical adjuvants such as alkali metal citrates to control burn properties.

It is, moreover, known as described in copending and coassigned U.S. patent application Ser. No. 334,120 filed Dec. 24, 1981, now U.S. Pat. No. 4,461,311 issued July 24, 1984 to Mathews, DeLucia and Mattina that the addition of extraordinary amounts of burn promotion additives to cigarette paper leads to a reduced emission, sidestream smoke. Cigarettes made with such papers normally would not have self-extinguishing properties, however.

Additionally, copending and coassigned U.S. patent application Ser. No. 627,710 filed July 11, 1984 describes wrapper constructions with specially designed paper structures that yield cigarettes that will self-extinguish when in contact with a surface, including many commonly encountered combustible surfaces. Such cigarettes, however, free burn continuously in air and do not self-extinguish under free burn conditions.

In summary, it remains desired to produce wrapper constructions for cigarettes and the like that would result in a cigarette reliably self-extinguishing in air after burning for a specified and controlled period of time. It is further desired to produce such wrapper constructions that accomplish this objective without significant deleterious effects on desired smoking properties.

SUMMARY OF THE INVENTION

The present invention is directed to wrapper constructions for smoking articles such as cigarettes that reliably impart controlled self-extinguishing properties to such cigarettes even when free burning in air. In accordance with the invention this result is obtained with a smoking article wrapper construction that includes a normally nonburning cellulose fiber base web that normally will not sustain burn on a smoking article and that is treated in a pluality of zones with a burn promoter in sufficient amount to maintain burn in the treated zone while permiting the smoking article to self-extinguish outside the zones if not puffed. Such smoking articles inherently are of reduced propensity to ignite surfaces or articles with which they come in contact such as by accidental dropping or the like. Smoking articles with wrappers of the present invention result in such benefits without a significant elevation in smoke delivery, thus satisfying the desires of smokers for lower tar delivery. In accordance with the invention, the wrappers and smoking articles may be white, opaque, and attractive in appearance, machine well on high speed cigarette making machines, require no new or unproven ingredients, and do not necessitate costly alterations in the manufacturing process or the composition of the wrapper construction.

In accordance with preferred embodiments of the invention, the wrappers have a structure defined by a "Burn Mode Index" (BMI), which is defined below and is a direct measure of a cigarette paper's ability to sustain continuous combustion of a cigarette supported in air. More specifically, they have a BMI between 1.5 $cm^{-1}$ and 6.0 $cm^{-1}$ for the single-wrapped embodiment. In an alternative embodiment a double-wrap configuration is employed wherein the inner wrapper is a paper with a BMI in the range of from about 0.1 $cm^{-1}$ to 4.0 $cm^{-1}$, and the outer-wrapper can be a conventional cigarette paper. Thus, in the double-wrap construction the BMI of the inner wrap may be reduced considerably while still attaining the benefits of the invention. In accordance with the preferred embodiments of the invention, the wrapper construction is treated in a plurality of selected zones with elevated amounts of an alkali metal burn promoter such as alkali metal salts of carboxylic acids. In the case of the double-wrapped cigarettes either the outer or the inner wrapper may be treated as described above; however, the performance of double-wrapped cigarettes is more effective when the outer wrapper, rather than the inner wrapper, is treated and this embodiment is, therefore, preferred.

When so treated, the resulting cigarette will burn normally in air until the treated zone is consumed and will reliably self-extinguish thereafter if not puffed. Thus, normal or only slightly elevated deliveries of smoke and tars as well as normal puff counts may be attained while yet achieving the desired self-extinguishing properties.

Preferred embodiments of the wrapper configurations of the present invention include a sheet containing flax or other cellulosic fibers and zones treated with an elevated amount of an alkali metal burn promoter, for example, carboxylic acid salts of sodium and, especially, potassium. Such wrappers desirably include mineral fillers for opacity.

DESCRIPTION OF THE PREFERRED EMBODIMENTS

In the description which follows, certain tests have been employed which will be described.

Figure 1:
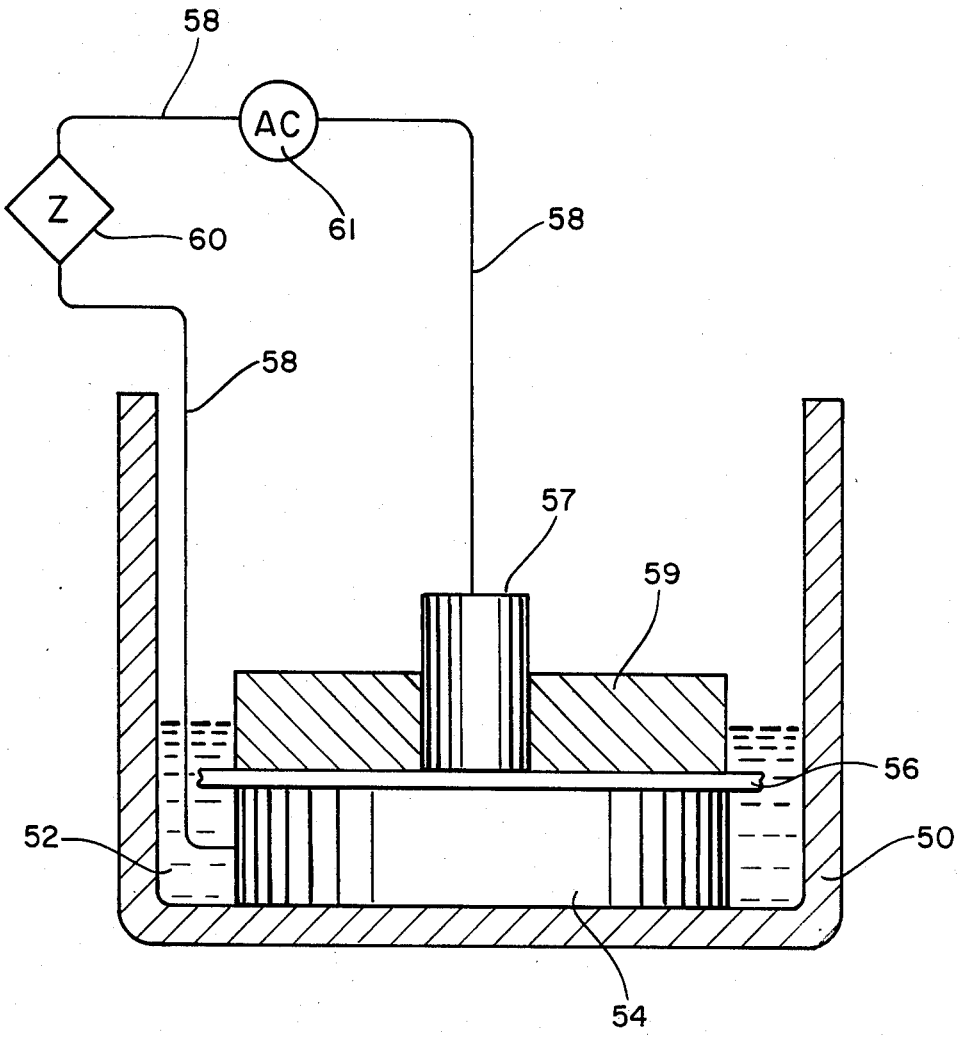
FIG. 1 depicts the apparatus for the determination of the Burn Mode Index.

The BMI test is based on the discovery that the wrapper's resistance to the flow of an electric current, when the paper is immersed in a non-aqueous solution of electrolyte and is placed between two electrodes, correlates very well with the ability of the wrapper to support combustion of a cigarette. The ratio of the intrinsic resistivity of the electrolyte solution (ohm-cm) to the product of the electrical resistance of the paper (ohm) and the area of paper in contact with both electrodes ($cm^2$) is defined as the "Burn Mode Index" (BMI), a direct measure of a wrapper's ability to support combustion of cigarettes. This electrical resistance was measured as a series resistance with an impedance bridge, Model 1658 manufactured by GenRad Corporation, using an alternating voltage at a 1 Khz frequency applied across the electrodes. The test cell is shown in FIG. 1. As shown therein as illustrated, glass vessel 50 contains electrolyte 52, for example, an 0.5 molar solution of tetraethylammonium chloride in butyrolactone. Bottom electrode 54, having a diameter of about 7.6 cm, for example, supports paper sample 56 upon which is placed a top electrode 57 having a diameter of about 1.4 cm, for example, and surrounded by a nonconductive support of, for example, Teflon 59 (polytetrafluoroethylene). The electrodes are connected by wire 58 through impedance bridge 60 providing an alternating current of 1 Khz frequency. The electrodes may be, for example, gold-plated brass cylinders. The BMI is determined by dividing the intrinsic resistivity of the solution by the product of the measured resistance and the area of paper in contact with both electrodes (in the case described, area = 1.6 $cm^2$).

The puff count was determined in accordance with standard FTC cigarette testing procedures. Carbon monoxide test results were obtained by gas chromatographic analysis of the smoke gas phase sampled during a puff.

The manufacture of paper for wrapping cigarettes is, of course, well established. Conventional practice employs traditional wet-laid manufacturing steps of fiber dispersion, dilution, deposition on a foraminous wire, water extraction, pressing, and drying. The fiber component for cigarette paper is preferably flax, but other cellulose fibers may be used instead of or in combination with flax. Mineral fillers such as precipitated calcium carbonate, ground limestone, calcined kaolinite, titania, diatomaceous earth, sodium silico aluminate, amorphous silica, calcium silicate, and others can be added for purposes of producing desired appearance and opacity, for example. As will be recognized by those familiar with papermaking, minerals of different particle size distribution, shape, and specific gravity may require alteration of fiber content or treatment such as refining or beating in order to obtain desired paper properties.

In accordance with the invention, however, it is required that the base wrapper construction in the single-wrap embodiment and the inner wrapper in the double-wrap embodiment be controlled within carefully defined limits such that cigarettes utilizing it will not free-burn continuously in a standard free-burn mode (as evidenced by cessation of smoke within five minutes) without the aid of burn promotion additives.

In the single-wrap embodiment, wrappers of the present invention preferably have a BMI within the range of from about 1.5 $cm^{-1}$ to about 6.0 $cm^{-1}$ and more preferably the BMI is in the range of from about 1.5 $cm^{-1}$ to about 3.5 $cm^{-1}$. For comparison BMI test values obtained on conventional wrappers are greater than 10 $cm^{-1}$ and usually are in excess of 15 $cm^{-1}$.

In the double-wrap configuration, the inner wrapper preferably has a BMI in the range of from about 0.1 $cm^{-1}$ to about 4.0 $cm^{-1}$, and more preferably in the range of from about 0.1 $cm^{-1}$ to about 2.0 $cm^{-1}$. The outer wrapper BMI level is dependent to some degree on the BMI of the inner wrapper and preferably is in the range of about 6 $cm^{-1}$ to about 25 $cm^{-1}$ and can be as low as 2 $cm^{-1}$ and as high as 40 $cm^{-1}$.

In accordance with the invention, however, it is necessary that the wrapper, which normally does not sustain free burn in the single-wrap design, or the outer wrapper in the double-wrap design be treated in a plurality of zones or areas with a burn promoting composition. This is preferably an alkali metal salt of citric acid, but other alkali-metal salts may be used, such as the salts of carbonic acid, formic acid, acetic acid, propionic acid, oxalic acid, malonic acid, succinic acid, glutaric acid, malic acid, lactic acid, glycolic acid, tartaric acid, and nitric acid. Mixtures of these salts or stoichiometrically equivalent amounts of other carboxylic acid salts of alkali metals can also by used. With wrapper constructions having BMI values greater than about 3.5 $cm^{-1}$, either sodium or potassium salts may be used. When the BMI is less than about 3.5 $cm^{-1}$, it is preferred that potassium salts be used since they more effectively promote free burn in such cases.

The ability of the wrapper constructions of the invention to promote vigorous burn of the cigarette in the treated zone and yet quickly self-extinguish in the base paper zone is maximized when the BMI is so low, i.e., in the previously defined preferred ranges, as to require high levels of burn promoter to achieve the desired free burn rate. The amount of the burn promoter must be great enough to allow a cigarette utilizing such wrapper to free-burn continuously in the treated zones. The level of the burn promoter used in practice is, preferably, higher than the minimum level required for burn continuity (shown in FIGS. 2 and 3 for the single-wrap and double-wrap configuration, respectively) and depends on the desired free-burn rate in the treated zones. The maximum level of burn promoter is about 150 mg of anhydrous potassium citrate per gram of bone dry base paper in the wrapper construction, because, above this point, the burn promoter begins to act as a burn retarder. Stoichiometrically equivalent amounts of other alkali-metal salts may be substituted for potassium citrate.

The area of the wrapper included in the treated zones will vary depending on the desired period of freeburn. However, each smoking article will include at least two zones of treatment, and each untreated area will be preferably equal to a band of about 2 to 15 and, preferably 4 to 10 mm in width to maximize reliability of self-extinction.

It is desirable, but not necessary, for the base paper to contain small amounts of an ash conditioner, such as potassium citrate. However, the amount of the ash conditioner must be below the level which allows the wrappers to support combustion of a cigarette, normally about 5 milligrams or less of potassium citrate or equivalent. Such amounts will correspondingly reduce the additional amounts of burn promoter required.

Cigarettes utilizing the above wrappers, either in the single or double wrap configuration, exhibit a desirable rate and continuity of free-burn in air within the treated zone but self-extinguish quickly and reliably outside the treated zone. This unique combination of properties demonstrates the highly improved and unexpected results obtained in accordance with the invention. In contrast, prior "banded" cigarettes with zones treated with chemicals intended to make the cigarette nonburning, consistently fail to achieve a desired balance of these properties. The benefits of this invention also include desired low tar deliveries and normal puff counts while yet reducing the likelihood of ignition of combustible substrates from cigarettes, especially when compared with prior art approaches of treating the normally burning wrapper with zones of burn-inhibiting treatments.

Thus, the wrapper and smoking article of the present invention comprising a base construction which does not normally sustain burn treated in desired zones with burn promoters permits maximum flexibility and control of the cigarette burn characteristics. There is no significant elevation in smoke delivery or puff count. The wrapper construction promotes normal burn of the cigarette in air and in ash trays within the treated zone and a reliable self-extinction in the nontreated zone. The treated zones comprise multiple areas along the cigarette length. Preferably, straight bands are used for the pattern of zones since this pattern produces the most reliable results.

EXAMPLES OF THE INVENTION

EXAMPLE 1 (Single wrap configuration)

A cigarette wrapper material was manufactured on a standard Fourdrinier paper machine using conventional refining and forming techniques known in making lightweight papers. The furnish used was Kraft cooked, bleached flax pulp, and 14% filler in the anatase form of titanium dioxide (Unitane 0-110 from American Cyanamid) was added. This paper had the following characteristics: Tappi opacity of 68%, tensile strength of 3800 g/29 mm, permeability of 4 cm/min at 1 centibar (as measured by the CORESTA method), basis weight of 21 g/m$^2$, and BMI of 2.5 cm$^{-1}$. A small amount of potassium citrate, 5 mg of anhydrous potassium citrate per gram of bone dry base paper, was added to the paper to serve as an ash conditioner for the untreated zones. Subsequently, this paper was treated with zones of potassium citrate, at a level of 90 mg of anhydrous potassium citrate per gram of bone dry base paper. These zones formed a repeating pattern consisting of bands of 13 mm length zones with the elevated chemical level and 5 mm length zones of the base paper.

Using standard cigarette manufacturing techniques, standard size, unfiltered cigarettes (25 mm circumference, 70 mm rod length) were made with this wrapper and a standard tobacco blend with a column density of 13.2 mg/mm. These cigarettes were lit and allowed to free burn suspended in air. All burned continually in the high chemical zone, but self-extinguished on reaching the first zone of base paper.

EXAMPLE 2 (Single-wrap configuration)

A base paper was made as in Example 1 using a furnish of standard northeastern bleached Kraft pulp. A filler of precipitated calcium carbonate in the calcite form with an average particle size of 0.75 micron consisting of barrel shaped prisms terminated by rhombohedrons marketed under the trade name of Albaglos (obtained from Pfizer, Inc., Minerals, Pigments and Metals Division) was used in the amount of 25% instead of the $Tio_2$ in Example 1. This paper had the following properties: Tappi opacity of 77%, tensile strength of 5200 g/29 mm, permeability of 1.5 cm/min (as measured by the CORESTA method), basis weight of 33 g/m$^2$, and BMI of 3.5 cm$^{-1}$. A small amount of potassium citrate, 5 mg of anhydrous potassium citrate per gram of bone dry base paper, was added to the paper to serve as an ash conditioner for the untreated zones. Subsequently, this paper was treated with zones of potassium citrate, at a level of 50 mg of anhydrous potassium citrate per gram of bone dry base paper. These zones formed a repeating pattern consisting of bands of 13 mm length zones with the elevated chemical level and 5 mm length zones of the base paper.

Using standard cigarette manufacturing techniques, standard size, unfiltered cigarettes (25 mm circumference, 70 mm rod length) were made with this wrapper and a standard tobacco blend having a column density of 13.2 mg/mm. These cigarettes were lit and allowed to free burn suspended in air. All burned continually in the high chemical zone, but self extinguished on reaching the first zone of base paper.

EXAMPLE 3 (Single-wrap configuration)

A third embodiment of the cigarette wrapper material of the present invention was made as in Example 1 using Kraft cooked, bleached flax pulp including 12% by weight of the $TiO_2$ described in Example 1 and 2% by weight of the calcium carbonate filler of Example 2. This paper had the following characteristics: Tappi opacity of 73%, tensile strength of 4600 g/29 mm, permeability of 2 cm/min (as measured by the CORESTA method), basis weight of 24 g/m$^2$, and BMI of 3.5 cm$^{-1}$. A small amount of potassium citrate, 5 mg of anhydrous potassium citrate per gram of bone dry base paper, was added to the paper to serve as an ash conditioner for the untreated zones. Subsequently, this paper was treated with zones of potassium citrate, at a level of 60 mg of anhydrous potassium citrate per gram of bone dry base paper. These zones formed a repeating pattern consisting of bands of 13 mm length zones with the elevated chemical level and 5 mm length zones of the base paper.

Using standard cigarette manufacturing techniques, standard size, unfiltered cigarettes (25 mm circumference, 70 mm rod length) were made with this wrapper and a standard tobacco blend having a column density of 13.2 mg/mm. These cigarettes were lit and allowed to free burn suspended in air. All burned continually in the high chemical zone, but self extinguished on reaching the first zone of base paper.

EXAMPLE 4 (Single-wrap configuration)

To illustrate the use of alternative base sheets for the wrapper of the present invention, the base sheet of Example 3 was selected for further treatment to lower its BMI. The BMI of the untreated sheet was 3.5 $cm^{-1}$. This sheet was treated by roll coating to achieve an add-on of 1% by weight of Ethylex 2005 (a hydroxyethyl starch obtained from A. E. Staley Manufacturing Company). The resulting paper had a BMI of 2.5 $cm^{-1}$. Cigarettes made with wrappers of this material treated similarly as in Example 1 with zones of elevated levels of potassium citrate had properties similar to those for Example 1.

Thus, conventional wrapper materials having typically high BMI values can be coated or saturated with suitable water soluble, film-forming materials to reduce the BMI to a level useful as base paper in accordance with the present invention. Examples of useful coating or impregnating materials include cellulose ethers such as methyl cellulose and carboxymethyl cellulose; starch or chemically modified starches such as hydroxyethylated or acetylated starch; guar gum or other vegetable gums; dextrin; and proteins, such as gelatin or refined vegetable proteins. The applications can be made on the paper machine, for example, at the size press, or it can be applied to the formed paper by separate operation such as coating or saturation techniques. Where the composition containing both the sealing material and the alkali metal additive is unstable, separate treatment steps may be used in either order.

EXAMPLE 5 (Double wrap configuration)

To illustrate the double-wrap embodiment of the invention, cigarettes were made using an inner wrapper with a BMI of 1.0 $cm^{-1}$ and no alkali metal salt and with a commercially available cigarette paper treated with zones of elevated levels of potassium citrate as the outer wrapper. The inner wrapper was manufactured in the same manner as the paper in Example 1. The physical properties of the inner wrapper were: Tappi opacity 68%, tensile strength of 4,000 g/29 mm, CORESTA permeability of 1 cm/min, and basis weight of 21 $g/m^2$ and BMI of 1 $cm^{-1}$. The outer wrapper was a commercial cigarette paper containing 30% precipitated calcium carbonate in the calcite form (trade name Albacar from Pfizer, Inc.) treated to contain a small amount of potassium citrate, 5 mg of anhydrous potassium citrate per gram of bone-dry paper, to serve as an ash conditioner for the untreated zones. Subsequently, this paper was treated with zones of potassium citrate, at a level of 60 mg of anhydrous potassium citrate per gram of bone-dry paper. These zones formed a repeating pattern consisting of bands of 13 mm length zones with the elevated chemical level and 5 mm length zones of the base paper. The physical properties of the outer wrapper were: Tappi opacity of 74%, tensile strength of 2400 g/29 mm, CORESTA permeability of 55 cm/min, and basis weight of 24 $g/m^2$ and BMI of 20 $cm^{-1}$.

Using standard cigarette manufacturing techniques, standard size, unfiltered cigarettes (25 mm circumference, 70 mm rod length) were made with this wrapper and a standard tobacco blend having a column density of 13.2 mg/mm. These cigarettes were lit and allowed to free burn suspended in air. All burned continually in the high chemical zone, but self-extinguished on reaching the first zone of base paper.

Table 1

In Table 1 examples of the invention are identified by numbers and are compared to wrappers, identified by letters, with BMI values outside the range of the invention, 1.5–6.0 $cm^{-1}$ for single wrapped and 0.1–4.0 $cm^{-1}$ for the inner wrapper of double-wrapped cigarettes.

Table 1 compares dry particulate matter ("DPM"), carbon monoxide delivery, free burn rate and puff count for cigarettes in accordance with the invention and conventional cigarettes. Since a low puff number is maintained, any increase in delivery can be reduced by filter tip dilution or, in the case of unfiltered cigarettes, by electrical perforation of the cigarette paper. With a low puff number, the tar per puff can be maintained. In addition the carbon monoxide delivery is not significantly increased. Conversely, the smoker will experience a normal consumption of the cigarette in the ash tray, except that it will self-extinguish in the ash tray after a designed time. For the cigarettes of Table 1, simulation of filter ventilation was achieved by reducing the puff volume in a normal F.T.C. smoking regime by the indicated degree of filter ventilation. All cigarettes were smoked for 47 mm.

TABLE 1

| | | | | | High Chemical Zone | |
|---|---|---|---|---|---|---|
| | Wrappers with BMI < 1.5 $cm^{-1}$ or BMI > 6.0 $cm^{-1}$ | BMI ($cm^{-1}$) | Permeability (cm/min) | Basis Weight ($g/m^2$) | Length High Chemical Zone (mm) | Alkali-Metal Salt Content (mg of anhydrous potassium citrate/g of bone dry base paper) |
| | | | Single-Wrapped Cigarettes | | | |
| Examples of the invention (1.5 $cm^{-1}$ ≦ BMI ≦ 6.0 $cm^{-1}$) | | | | | | |
| 1 | | 2.5 | 4.0 | 21 | 13 | 90 |
| 2 | | 3.5 | 1.5 | 33 | 13 | 50 |
| 3 | | 3.5 | 2.0 | 24 | 13 | 60 |
| | A | 7.0 | 6.0 | 24 | 0 | 0 |

TABLE 1-continued

| | | | | | | | | |
|---|---|---|---|---|---|---|---|---|
| | B | 15.0 | 25 | 24 | 0 | | | 0 |
| | | Double-Wrapped Cigarettes - Outer Wrapper/Inner Wrapper | | | | | | |
| Examples of the Invention ($0.1\ cm^{-1} \leqq BMI \leqq 4.0\ cm^{-1}$) | | | | | | | | |
| 5 | | 20/1.0 | 55/1 | 24/21 | 13/0 | | | 60/0 |

| | Wrappers with BMI < 1.5 $cm^{-1}$ or BMI > 6.0 $cm^{-1}$ | Low Chemical Zone: Length Low Chemical Zone (mm) | Low Chemical Zone: Alkali Metal Salt Content (mg of anhydrous potassium citrate/g of bone dry base paper) | Filter Venti. (%) | Tobacco Column Density (mg/mm) | Puff Count | DPM (mg/cig) | Carbon Monoxide (mg/cig) |
|---|---|---|---|---|---|---|---|---|
| | | Single-Wrapped Cigarettes | | | | | | |
| Examples of the invention ($1.5\ cm^{-1} \leqq BMI \leqq 6.0\ cm^{-1}$) | | | | | | | | |
| 1 | | 5 | 5 | 30 | 13.2 | 10 | 25.9 | 17.6 |
| 2 | | 5 | 5 | 30 | 13.2 | 10 | 25.0 | 18.7 |
| 3 | | 5 | 5 | 30 | 13.2 | 10 | 25.8 | 17.5 |
| | A | 70 | 8 | 20 | 13.2 | 9.5 | 23.0 | 14.3 |
| | B | 70 | 8 | 0 | 13.2 | 8 | 25.4 | 16.7 |
| | | Double-Wrapped Cigarettes - Outer Wrapper/Inner Wrapper | | | | | | |
| Examples of the Invention ($0.1\ cm^{-1} \leqq BMI \leqq 4.0\ cm^{-1}$) | | | | | | | | |
| 5 | | 5/0 | 5/0 | 30 | 13.2 | 8 | 20.8 | 17.9 |

FIGS. 1–7

FIG. 1 depicts the testing apparatus for determining the BMIs of wrappers.

Figure 2:
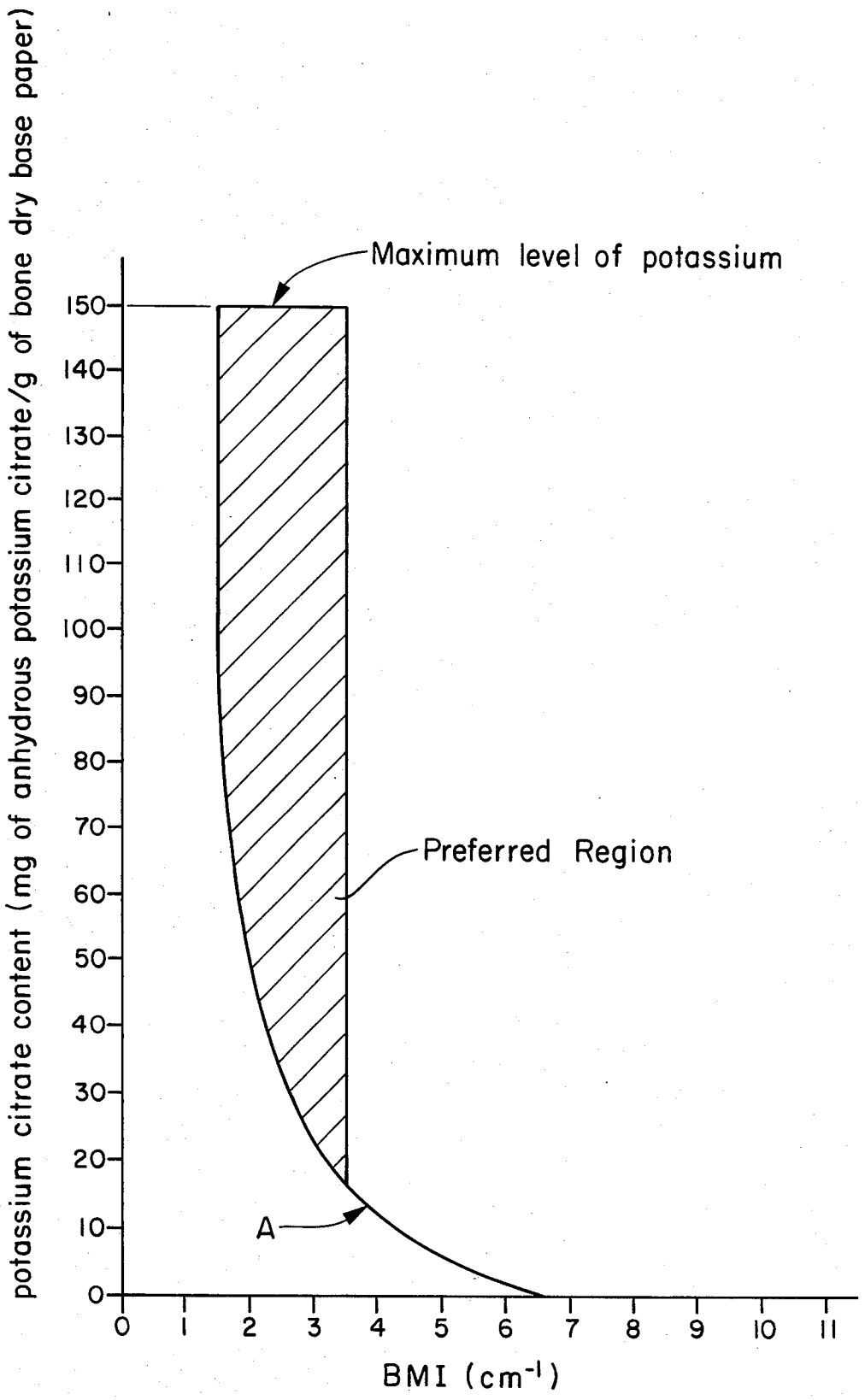
FIG. 2 illustrates in graph form the decreasing amounts of alkali metal salt (as potassium citrate) required to obtain burn continuity as a function of increasing BMI.

FIG. 2 shows that the amount of alkali-metal salt (as potassium citrate) required to obtain burn continuity decreases as the BMI of the single wrapper configuration increases. The preferred BMI range is shaded.

Figure 3:
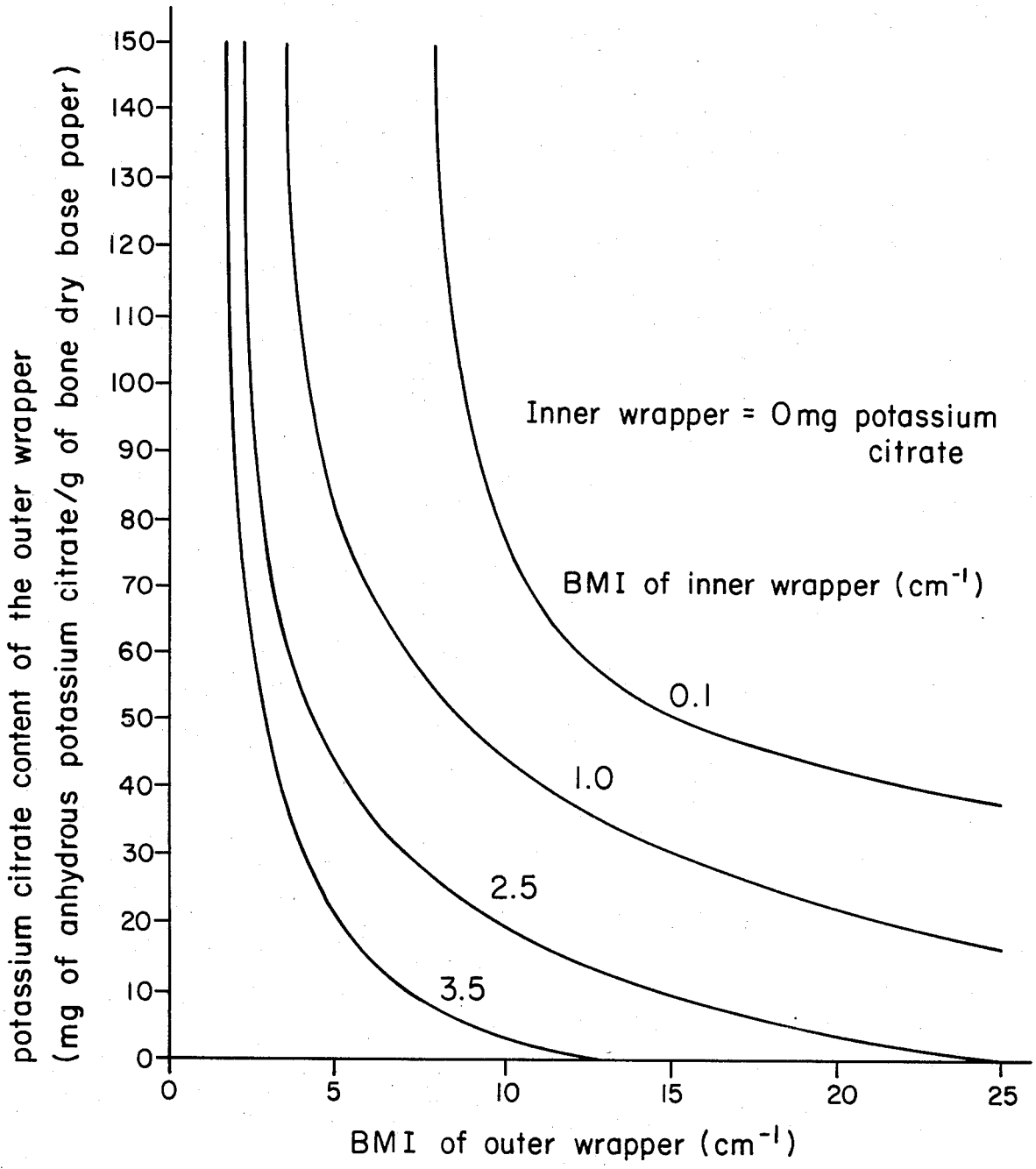
FIG. 3 is a graph similar to that of FIG. 2 only with respect to the double-wrapped configuration.

FIG. 3 shows for several different BMI values of the inner wrapper, the amount of potassium citrate required in the outer wrapper to obtain burn continuity as a function of the BMI of the outer wrapper. The amount of potassium citrate can be, depending on the desired free burn rate in the treated zones, between the minimum required for burn continuity and about 150 mg per gram of bone-dry base paper, a level beyond which additional amounts of potassium citrate act as burn retarder. The area to the right of the respective curves defines useful combinations of burn promoter and outer wrapper BMI.

Figure 4:
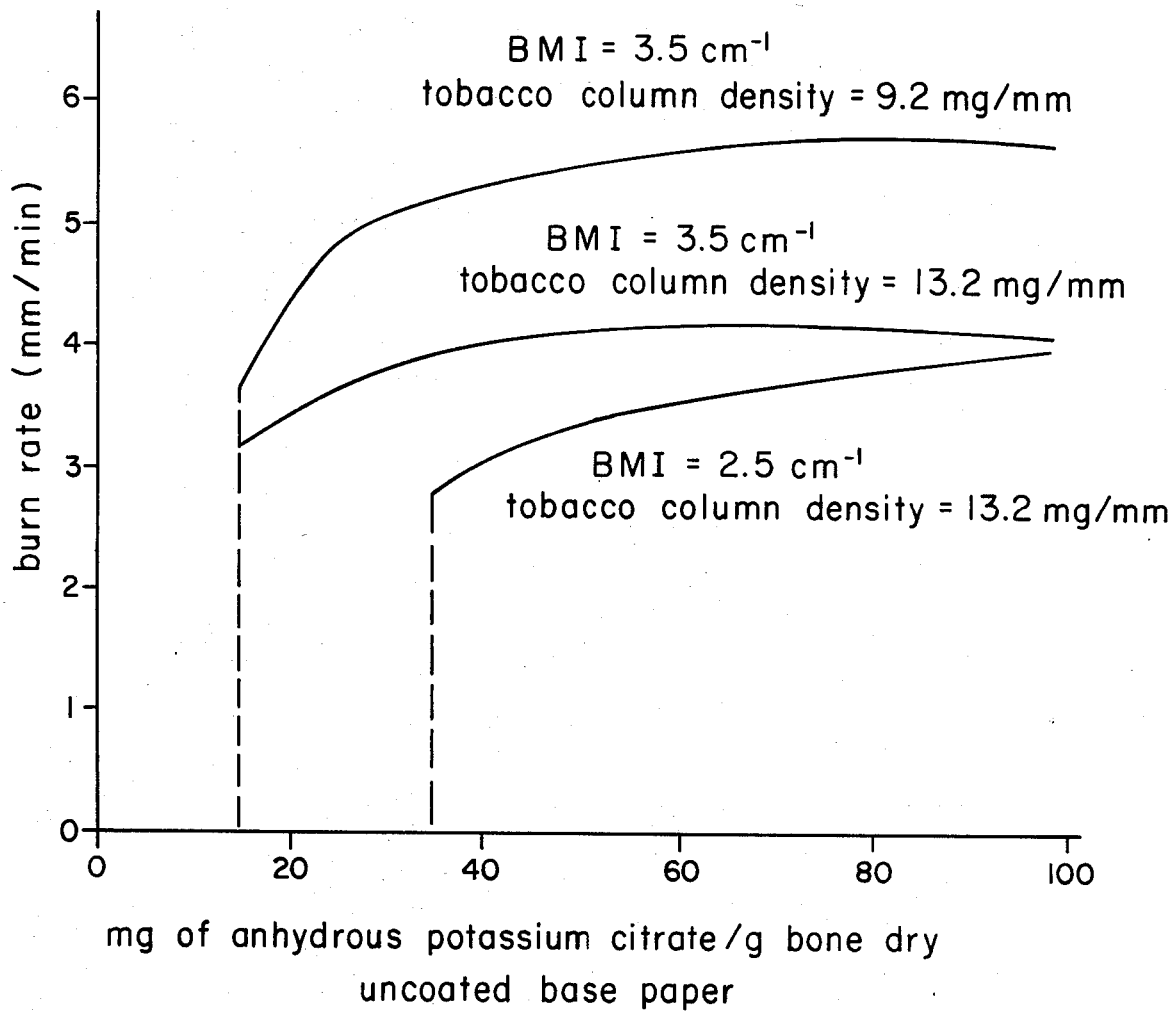
FIG. 4 illustrates in graph form the free-burn rate in the treated zones on the wrapper of cigarettes of the invention as a function of the level of the burn promoter, potassium citrate.

FIG. 4 shows that the preferred wrapper constructions for single-wrapped cigarettes having the defined BMI range will not sustain combustion unless driven with elevated levels of burn promoter. The top line represents a BMI of 3.5 $cm^{-1}$ and tobacco column density of 9.2 mg/mm. The middle line represents the same BMI with a tobacco column density of 13.2 mg/mm. The bottom line represents a BMI of 2.5 $cm^{-1}$ and tobacco column density of 13.2 mg/mm. While the level of burn promoter necessary will vary depending on the promoter used and the composition and construction of the smoking article, it may be readily determined by observation of burn sustaining tests. The level will be at least adequate to maintain free burn and preferably greater in order to achieve a faster burn rate.

Figure 5:
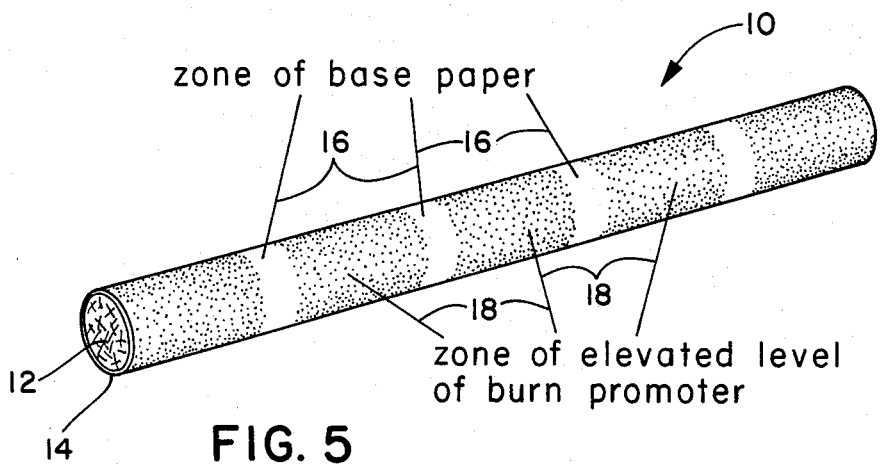
FIG. 5 illustrates a cigarette manufactured in accordance with the single wrap construction of the invention showing representative treated and untreated zones.
Figure 6:
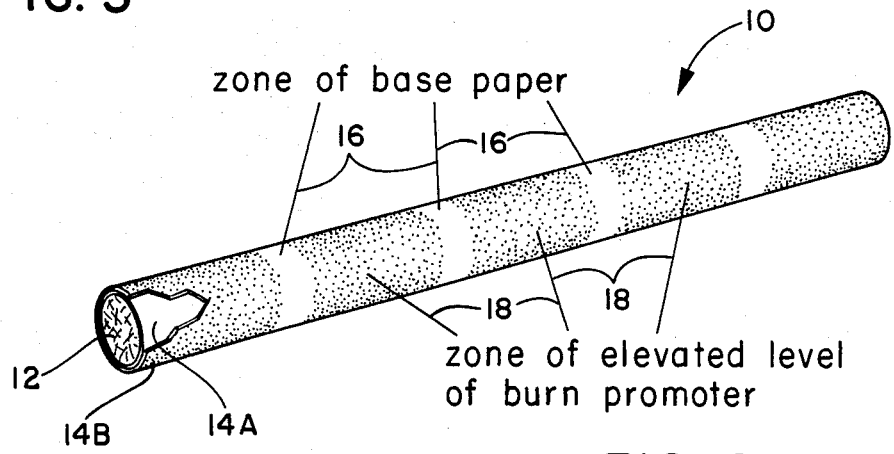
FIG. 6 is an illustration like that of FIG. 5 showing a double-wrap construction in accordance with the invention.

Turning to the FIG. 5, one form of wrapper and cigarette construction is illustrated. As shown, cigarette 10 includes tobacco 12 and wrapper 14. Wrapper 14 is comprised of non-burn sustaining paper 16, treated in zones 18 with burn promoting materials. It will be recognized that, while distinguished in the drawings for illustrative purposes, the zones will not normally be visually detectable although they may be if desired. FIG. 6 similarly illustrates a double-wrapped construction including inner wrap 14A and outer wrap 14B.

Figure 7A:
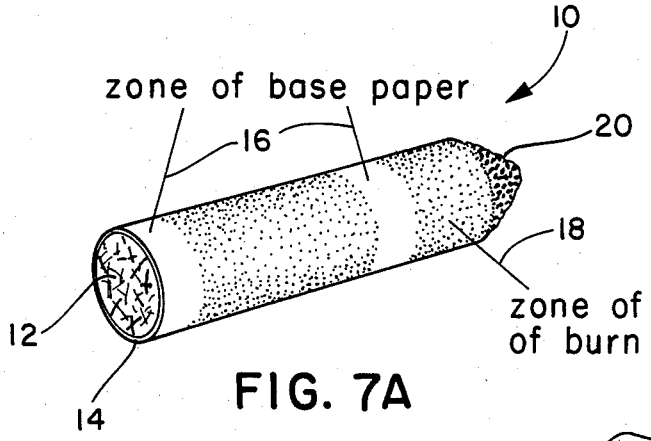
FIGS. 7A–7C illustrate burn characteristics of cigarettes made in accordance with the present invention.
Figure 7B:
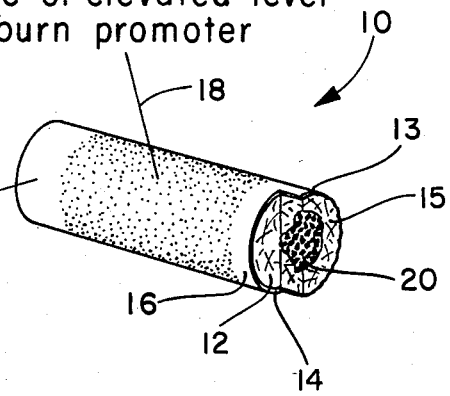
Figure 7C:
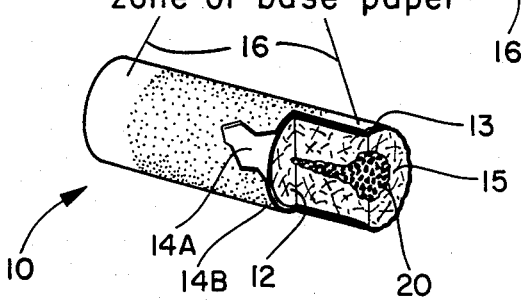

FIGS. 7A–7C illustrate schematically burning performance of single and double-wrapped cigarettes with wrappers of the present invention. While it is not desired to limit the invention to a theory, it is believed that the elevated levels of burn promoter cause base papers, which normally do not sustain a continuous free-burn of a cigarette, to support combustion due to the burn promoter causing the wrapper to burn back ahead of the coal. This requires that the paper be at a temperature at least about 200° C. caused by the hot tobacco coal burning in close proximity to the wrapper. Through the zone 18 (FIG. 7A) of elevated burn chemical cigarette 10 burns as a conventional cigarette. When the coal 20 reaches the zone 16 of base paper, the absence of elevated levels of burn promoter results in the paper char line 13 lagging the progression of the coal 20 (FIG. 7B). As there is insufficient oxygen flow through the paper to support combustion of the coal, the coal begins to extinguish from the paper surface toward the center of the cigarette. As the hot coal progresses, it begins to neck in, leaving a cool zone 15 of charred and uncharred tobacco against the paper surface. If the coal should survive into the next zone of burn promoter (FIG. 7C), there is not sufficient heat at the paper surface to break down the paper structure, and, as the base paper admits insufficient oxygen to support the coal, the coal extinguishes. The improved wrapper constructions and smoking article of the present invention can be made by application of existing papermaking and printing or coating technologies as will be apparent to those skilled in these arts. Achieving the sheet characteristics required to obtain the BMI values prescribed for the preferred embodiments may be accomplished by selection of fiber beating conditions and by control of the amounts and morphologies of mineral fillers incorporated in the paper.

Thus, it is apparent that there has been provided in accordance with the invention a wrapper for smoking articles and smoking articles that fully satisfy the objectives, aims, and advantages set forth above. Although the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A single wrapper construction for a smoking article, said wrapper construction comprising a base web containing cellulose fibers, said base web being nonburning under normal smoking conditions, said base web containing a plurality of zones treated with a burn promoter in sufficient amount to cause said wrapper construction in use to maintain burn of said smoking article within said zones but said wrapper construction causing said smoking article to self-extinguish outside of said zones if not puffed.

2. The wrapper construction of claim 1 wherein said base web has a BMI in the range of from about 1.5 $cm^{-1}$ to 6.0 $cm^{-1}$.

3. The wrapper construction of claim 1 wherein said base web has a BMI in the range of from about 1.5 $cm^{-1}$ to 3.5 $cm^{-1}$.

4. The wrapper construction of claim 1 having a BMI and burn promoter level as anhydrous potassium citrate or equivalent alkali metal salt defined by the shaded area of FIG. 2 as follows:

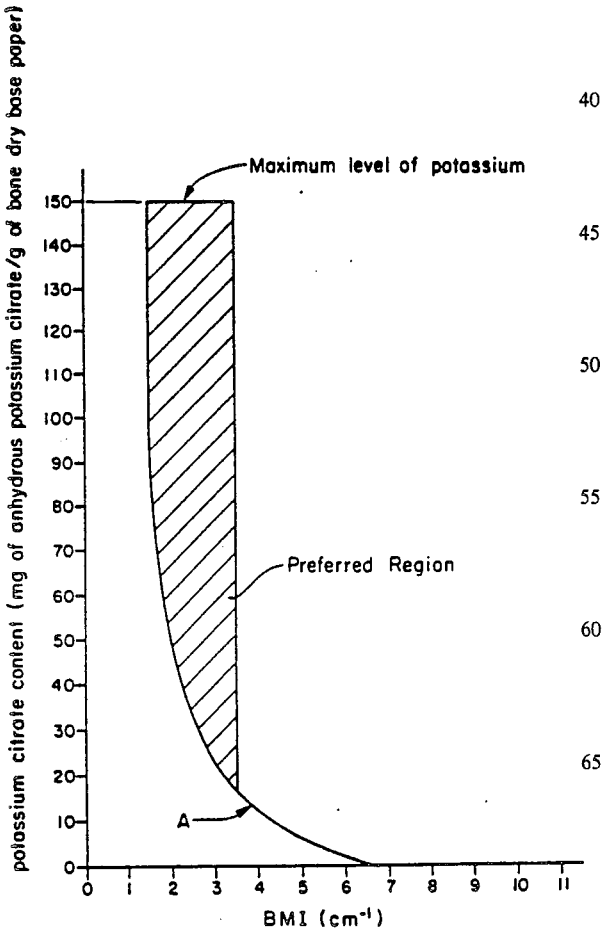

5. A double wrapper construction for a smoking article, said wrapper construction comprising an inner base web that contains cellulose fibers and is nonburning under normal smoking conditions and an outer base web, said combination of inner base web and outer base web containing a plurality of zones treated with a burn promoter in sufficient amount to cause said wrapper construction in use to maintain burn of said smoking article within said zones but said wrapper construction causing said smoking article to self-extinguish outside of said zones if not puffed.

6. The wrapper construction of claims 1 or 5 wherein said cellulose fibers comprise flax.

7. The wrapper construction of claims 1 or 5 wherein said burn promoter is an alkali metal salt, and said zones constitute bands.

8. The wrapper construction of claim 5 wherein said inner base web has a BMI in the range of from about 0.1 $cm^{-1}$ to 4.0 $cm^{-1}$.

9. The wrapper construction of claim 5 wherein said inner base web has a BMI in the range of from about 0.1 $cm^{-1}$ to 2.0 $cm^{-1}$ and said outer base web has a BMI in the range of from about 6.0 $cm^{-1}$ to about 25 $cm^{-1}$.

10. The wrapper construction of claim 2 having a BMI of the outer base web and burn promoter level as anhydrous potassium citrate or equivalent alkali metal salt as defined by the areas to the right of the respective curves of FIG. 3 depending on the BMI of the inner base web as follows:

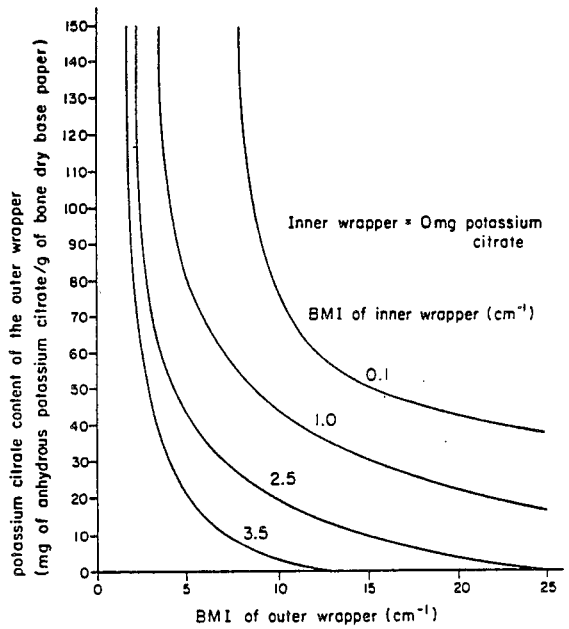

11. A smoking article comprising a tobacco column and a single wrapper construction, said wrapper construction comprising a base web containing cellulose fibers, said base web being nonburning under normal smoking conditions, said base web containing a plurality of zones treated with a burn promoter in sufficient amount to cause said wrapper construction in use to maintain burn of said smoking article within said zones but said wrapper construction causing said smoking article to self-extinguish outside of said zones if not puffed.

12. A smoking article as in claim 11 wherein said base web has a BMI in the range of from about 1.5 $cm^{-1}$ to 6.0 $cm^{-1}$.

13. A smoking article as in claim 11 wherein said base web has a BMI in the range of from about 1.5 $cm^{-1}$ to 3.5 $cm^{-1}$.

14. A smoking article as in claim 11 wherein said wrapper construction has a BMI and burn promoter level as anhydrous potassium citrate or equivalent alkali metal salt defined by the shaded area of FIG. 2 as follows:

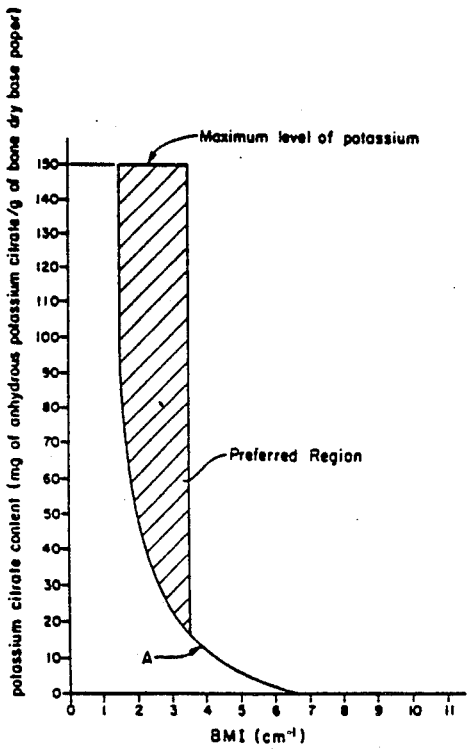

15. A smoking article comprising a tobacco column and a double wrapper construction, said wrapper construction comprising an inner base web that contains cellulose fibers and is nonburning under normal smoking conditions and an outer base web, said combination of inner base web and outer base web containing a plurality of zones treated with a burn promoter in sufficient amount to cause said wrapper construction in use to maintain burn of said smoking article within said zones but said wrapper construction causing said smoking article to self-extinguish outside of said zones if not puffed.

16. A smoking article as in claims 11 or 15 wherein said cellulose fibers comprise flax.

17. A smoking article as in claims 11 or 15 wherein said burn promoter is an alkali metal salt, and said zones constitute bands.

18. A smoking article as in claim 15 wherein said inner base web has a BMI in the range of from about 0.1 $cm^{-1}$ to 4.0 $cm^{-1}$.

19. A smoking article as in claim 15 wherein said inner base web has a BMI in the range of from about 0.1 $cm^{-1}$ to 2.0 $cm^{-1}$ and said outer base web has a BMI in the range of from about 6.0 $cm^{-1}$ to 25 $cm^{-1}$.

20. A smoking article as in claim 15 wherein said wrapper construction has a BMI of the outer base web and burn promoter level anhydrous potassium citrate or equivalent alkali metal salt as defined by the areas to the right of the respective curves of FIG. 3 as follows depending on the BMI of the inner base web:

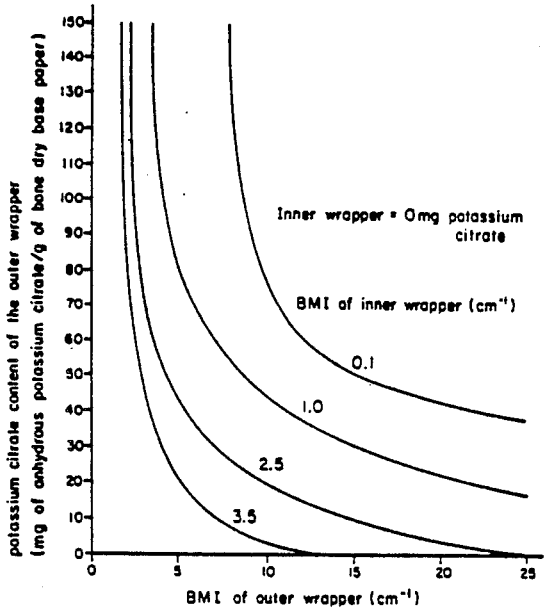

* * * * *